US011384454B2

(12) United States Patent
D'Agnolo et al.

(10) Patent No.: US 11,384,454 B2
(45) Date of Patent: Jul. 12, 2022

(54) DRAWING AND SPINNING APPARATUS AND METHOD OF MIXED YARNS FOR AIR SPINNING MACHINES WITH MULTIPLE FEEDS

(71) Applicant: SAVIO MACCHINE TESSILI S.p.A., Pordenone (IT)

(72) Inventors: Fabio D'Agnolo, Pordenone (IT); Luca Deotto, Pordenone (IT)

(73) Assignee: SAVIO MACCHINE TESSILI S.P.A., Pordenone (IT)

( * ) Notice: Subject to any disclaimer, the term of this patent is extended or adjusted under 35 U.S.C. 154(b) by 69 days.

(21) Appl. No.: 16/596,391

(22) Filed: Oct. 8, 2019

(65) Prior Publication Data

US 2020/0263328 A1 Aug. 20, 2020

(30) Foreign Application Priority Data

Oct. 9, 2018 (IT) ..... 102018000009292

(51) Int. Cl.
*D01H 4/02* (2006.01)
*D01H 4/34* (2006.01)
*D01H 4/38* (2006.01)

(52) U.S. Cl.
CPC ..... *D01H 4/02* (2013.01); *D01H 4/34* (2013.01); *D01H 4/38* (2013.01)

(58) Field of Classification Search
CPC ..... D01H 4/34; D01H 4/38; D01H 13/04; D01H 5/72; D01H 5/00; D01H 1/115
See application file for complete search history.

(56) References Cited

U.S. PATENT DOCUMENTS 4,112,658 A * 9/1978 Morihashi ..... D02G 1/04 57/328
4,206,589 A * 6/1980 Markey ..... D02G 3/286 57/293

(Continued)

FOREIGN PATENT DOCUMENTS

DE 3043957 A1 7/1982
DE 102007051655 A1 * 4/2009 ..... D01H 1/115

(Continued)

OTHER PUBLICATIONS

Search Report and Written Opinion issued by the Italian Ministry of Economic Development for corresponding Italian Application No. 10201800009292 dated May 15, 2019.

*Primary Examiner* — Shaun R Hurley
*Assistant Examiner* — Patrick J. Lynch
(74) *Attorney, Agent, or Firm* — Moore & Van Allen PLLC; Henry B. Ward, III

(57) ABSTRACT

A drawing and spinning apparatus of mixed yarns for air spinning machines with multiple feeds comprises at least a first and a second introducer element, an air spinning device, a drawing device, interposed between the introducer elements and the air spinning device, an air spinning chamber, an introducer nozzle shaped to receive the webs from the drawing device into respective insertion channels and introduce the webs into the spinning chamber according to a longitudinal feeding direction. With respect to a cross-section plane perpendicular to the longitudinal feed direction, groove bottoms of each of the two insertion channels of the webs into the chamber are aligned along a segment which is offset by an eccentricity with respect to a geometric centre of the chamber itself, through which a symmetry axis of the spinning chamber passes, the eccentricity being less than 5% of a maximum diameter of the spinning chamber.

23 Claims, 13 Drawing Sheets

(56) References Cited

U.S. PATENT DOCUMENTS

| | | | | | |
|---|---|---|---|---|---|
| 4,711,080 | A * | 12/1987 | Shibazaki | D01H 1/115 | 57/12 |
| 5,107,671 | A | 4/1992 | Morihashi et al. | | |
| 5,115,630 | A * | 5/1992 | Vanhelle | D02G 3/367 | 57/58.59 |
| 5,428,870 | A * | 7/1995 | Rutz | D01H 5/32 | 19/240 |
| 5,531,063 | A * | 7/1996 | Sawhney | D01H 13/04 | 19/244 |
| 5,621,948 | A * | 4/1997 | Hartung | B65H 67/0434 | 19/150 |
| 5,775,087 | A * | 7/1998 | Goineau | D02G 3/346 | 57/350 |
| 2007/0028422 | A1* | 2/2007 | Minter | D01G 31/006 | 19/239 |
| 2012/0144794 | A1* | 6/2012 | Ke | B32B 5/02 | 57/90 |
| 2017/0073851 | A1* | 3/2017 | Schneider | D01H 5/72 | |
| 2017/0268134 | A1* | 9/2017 | Xue | D02G 3/346 | |

FOREIGN PATENT DOCUMENTS

| | | | | |
|---|---|---|---|---|
| EP | 1207225 | A2 * | 5/2002 | D01H 4/02 |
| EP | 1518949 | A2 * | 3/2005 | D01H 1/115 |
| WO | WO-2008141700 | A1 * | 11/2008 | D01H 4/02 |
| WO | WO-2011084113 | A1 * | 7/2011 | D01H 5/72 |

* cited by examiner

DRAWING AND SPINNING APPARATUS AND METHOD OF MIXED YARNS FOR AIR SPINNING MACHINES WITH MULTIPLE FEEDS

FIELD OF APPLICATION

The present invention relates to an apparatus and a method for drawing and spinning mixed yarns for air spinning machines, for example of the air-jet type, with multiple feeds.

BACKGROUND OF THE INVENTION

As is known, air-jet spinning apparatuses produce the yarn production starting from a single fibre web. The specific area of development of the present invention is that of the yarns obtained from several fibre webs which can be of different materials, of different colours (mélange), of different quality or even of the same material. These multiple feed belts must be appropriately stretched and mixed so as to produce a yarn with the desired features, in a controllable and repeatable manner.

To date, the process for obtaining yarns starting from multiple webs (double web) with different colouring or material has some drawbacks and limitations.

In fact, there are often barring phenomena which consist in the creation of grooves or strips which can typically be due to irregularities in the yarn count or twist.

In summary, typically the bars are due to incorrect couplings, irregular tensions and irregular twists between threads/fibres.

In the case of use of double webs in the feed of air spinning apparatuses, in order to limit this defect, it is known, by the same applicant, to carry out the complete separation of the path of the two webs, in such a way as to keep them separated until entry to the introducer nozzle. This separation is also, and mainly, used in order to strengthen the mechanical properties of the thread.

In any case, the mere separation of the webs is not sufficient to solve the problem of the bars in the event that one tries to obtain mixed yarns by means of air spinning machines.

Furthermore, the 'extreme' separation of the webs so as to separate the fibres up to the direct exposure to the air flows in the chamber, if on the one hand limits the phenomenon of the bars, on the other it introduces problems on the colorimetric yield of the final yarn.

For example, taking as a reference a melange made with 50% of black tape and 50% of white tape in a known type of apparatus, depending on the side of insertion of the black tape (right or left) the colorimetry of the final yarn is different, that is darker or lighter.

Obviously, the variability of the result as a function of the direction of insertion of the yarns constitutes a further complication in the setup of the machine because it would require greater attention in laying the webs being fed.

In summary, these bars can occur not only when two different coloured webs are used, but also when using webs of the same colour, of the same material and of mixed material (for example cotton/polyester or viscose/polyester). In other words, the problem of the bars and of the non-uniformity of the colour can occur every time at least two webs are used, even equal to each other, due to the possible non-uniformities that occur at the moment of joining the same webs in the spinning chamber.

The need of solving the drawbacks and limitations mentioned with reference to the prior art is therefore felt.

BRIEF SUMMARY OF THE INVENTION

Such a need is met by a drawing and spinning apparatus of mixed yarns for air spinning machines with multiple feeds according to the invention as disclosed and described herein and by a drawing apparatus for air-spinning machines according to the invention as disclosed and described herein.

According to one embodiment, the invention comprises a drawing and spinning apparatus of mixed yarns for air spinning machines with multiple feeds. The drawing and spinning apparatus comprises at least a first and a second introducer element, independent of each other, so as to be able to feed simultaneously at least two separate webs of textile fibre. The drawing and spinning apparatus comprises an air spinning device suitable to spin said webs of textile fibre and an air spinning device chamber for interweaving said webs of textile fibres. The drawing and spinning apparatus comprises an introducer nozzle shaped to receive the webs from a drawing device, placed between the introducer nozzle and the air spinning device, inside respective insertion channels and to introduce the webs inside the spinning chamber in a longitudinal feed direction. In one embodiment, the spinning chamber comprises a plurality of jets of air oriented in a direction substantially tangential to the webs in input to the spinning chamber, so as to interweave the webs and obtain a single yarn in output from the spinning chamber. With respect to a cross-section plane perpendicular to the longitudinal feed direction, in one embodiment, groove bottoms of each of the two insertion channels of the webs into the spinning chamber are aligned along a segment which is offset by an eccentricity with respect to a geometric centre of the spinning chamber, through which a symmetry axis of the spinning chamber passes, the eccentricity being less than 5% of a maximum diameter of the spinning chamber. In a further embodiment, with respect to a cross-section plane perpendicular to the longitudinal feed direction, the cross-section of the insertion channels, at the spinning chamber, has a triangular profile converging and rounded at the groove bottoms.

BRIEF DESCRIPTION OF THE SEVERAL VIEWS OF THE DRAWING

Further features and advantages of the present invention will appear more clearly from the following description of preferred non-limiting embodiments thereof, in which.

Elements or parts of elements in common to the embodiments described below are referred to with the same reference numerals.

DETAILED DESCRIPTION OF THE INVENTION

Figure 1:
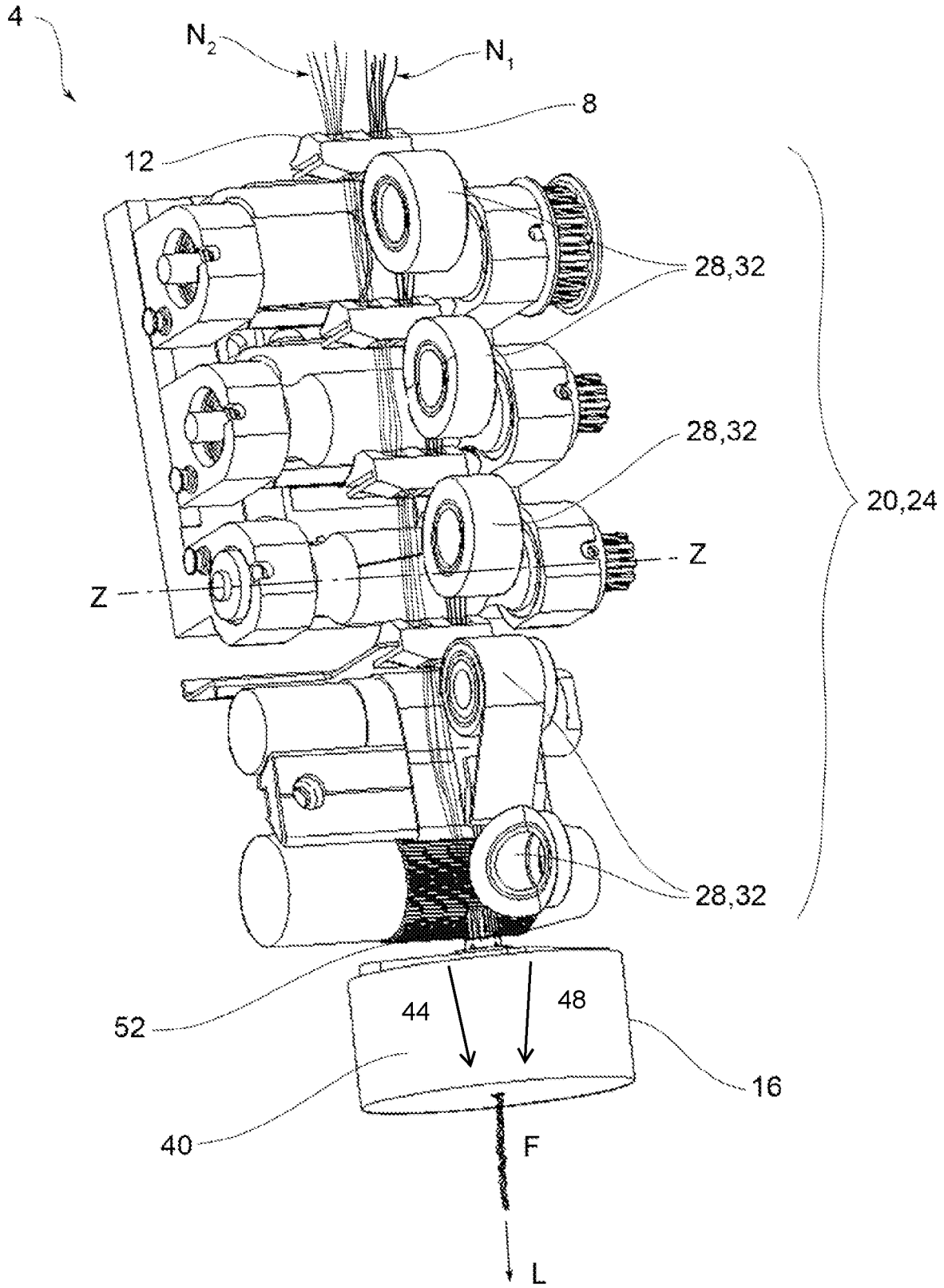
FIGS. 1-2 show a perspective view and a side view of a drawing apparatus for air-spinning machines for mixed yarns, according to an embodiment of the present invention.
Figure 2:
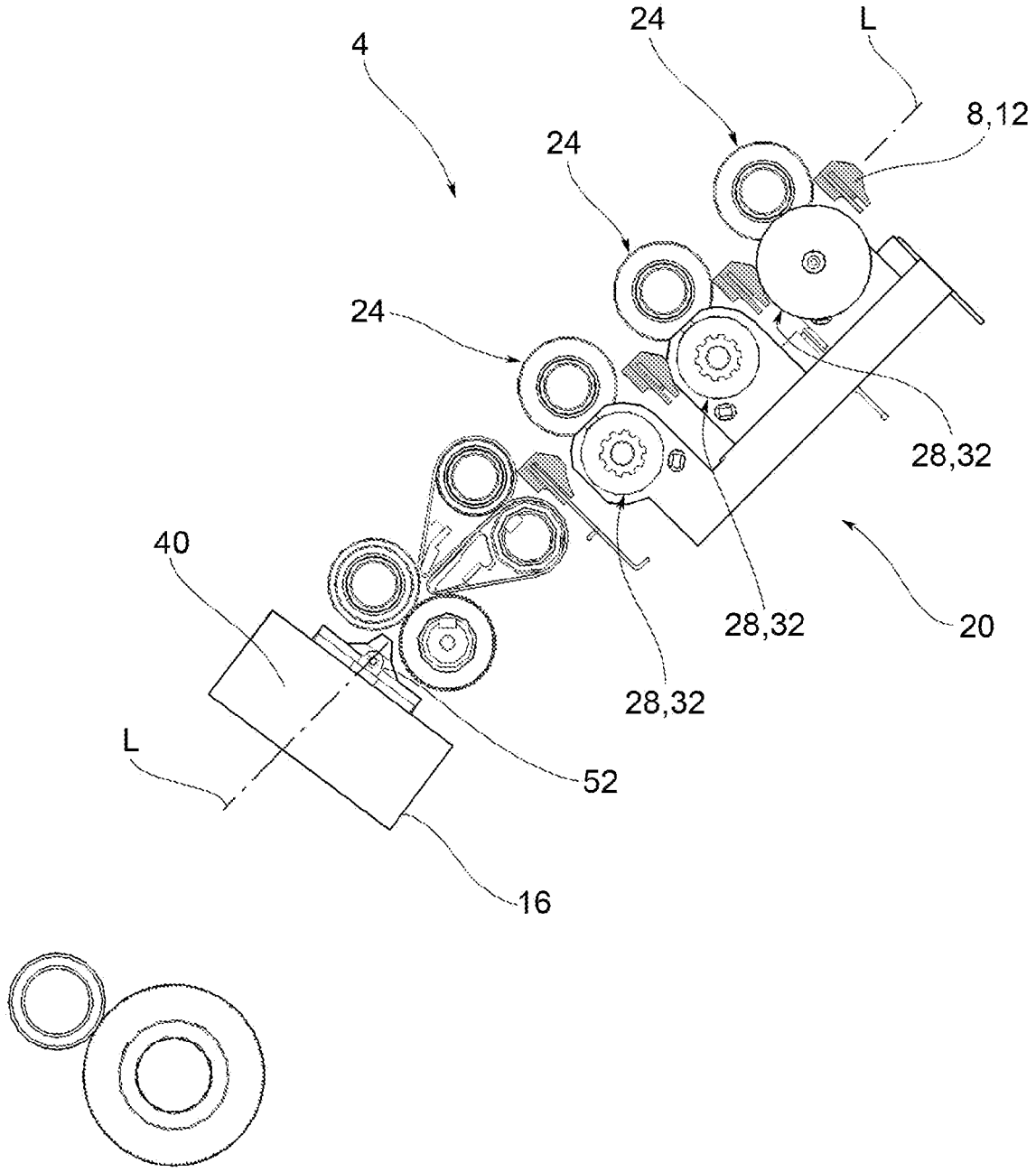
Figure 3:
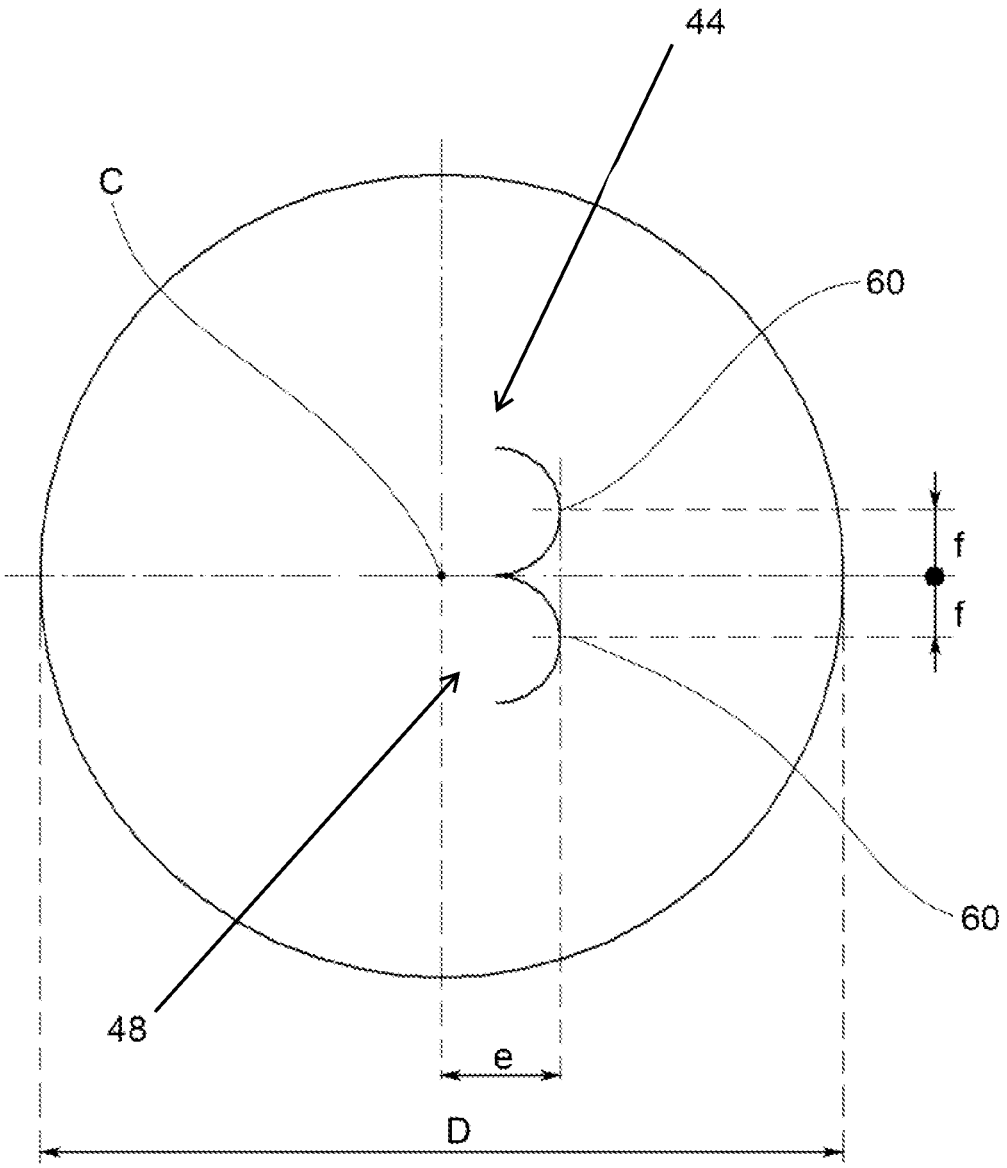
FIG. 3 shows a schematic view of the introducer nozzle at the inlet section of the spinning chamber.
Figure 4:
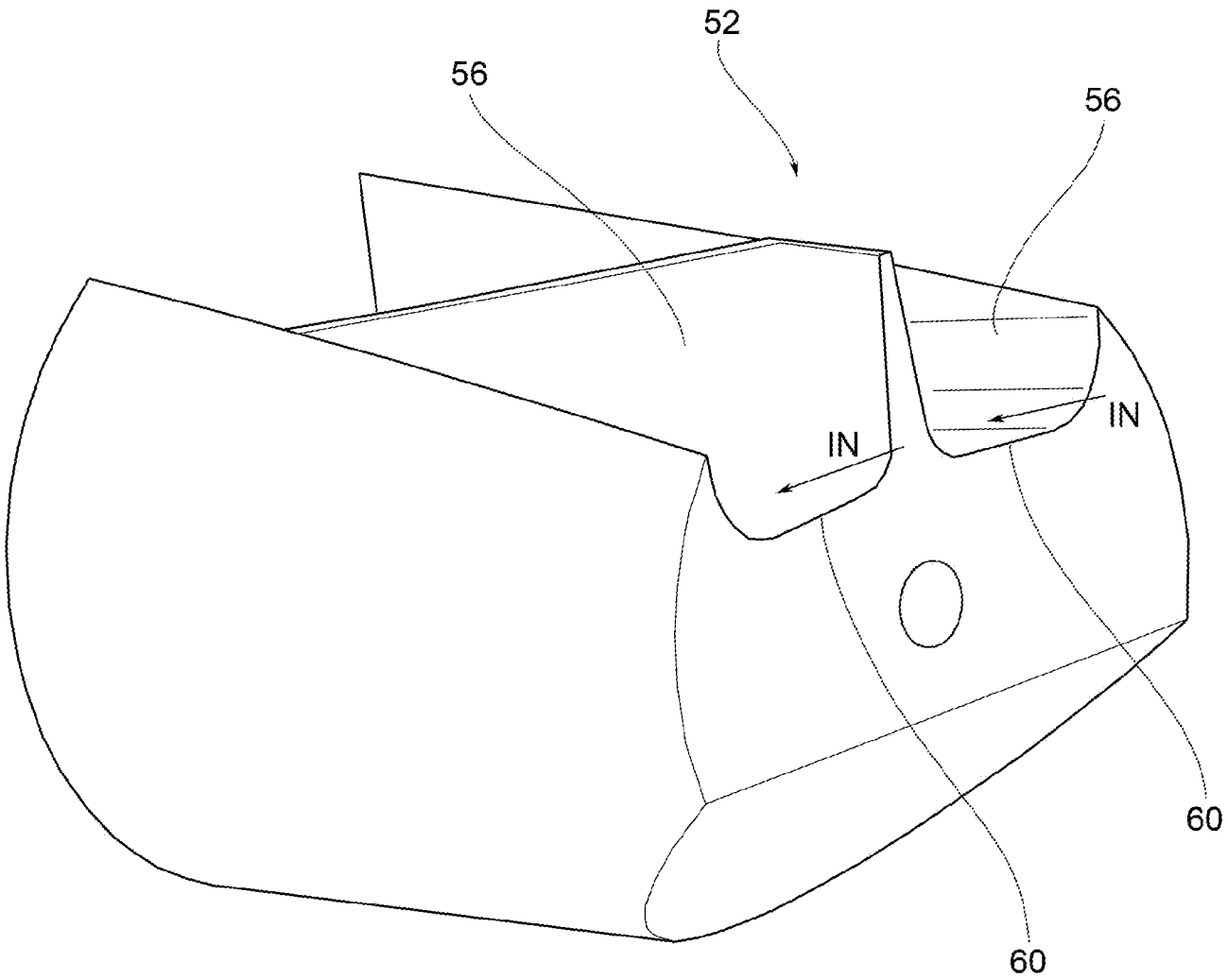
FIGS. 4-5 show perspective views, from the inlet side and from the outlet side, of an introducer nozzle according to a possible embodiment of the present invention.
Figure 5:
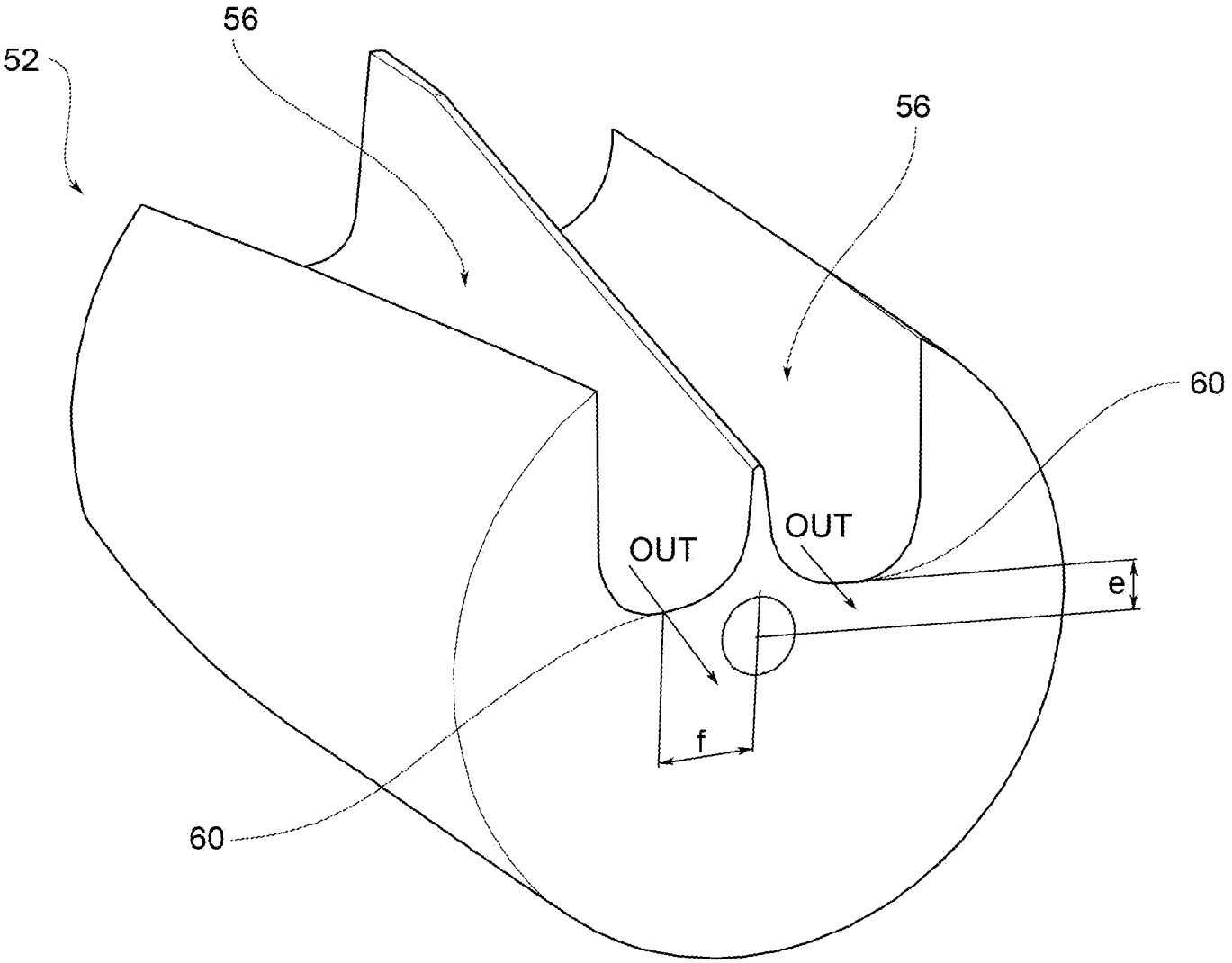
Figure 6:
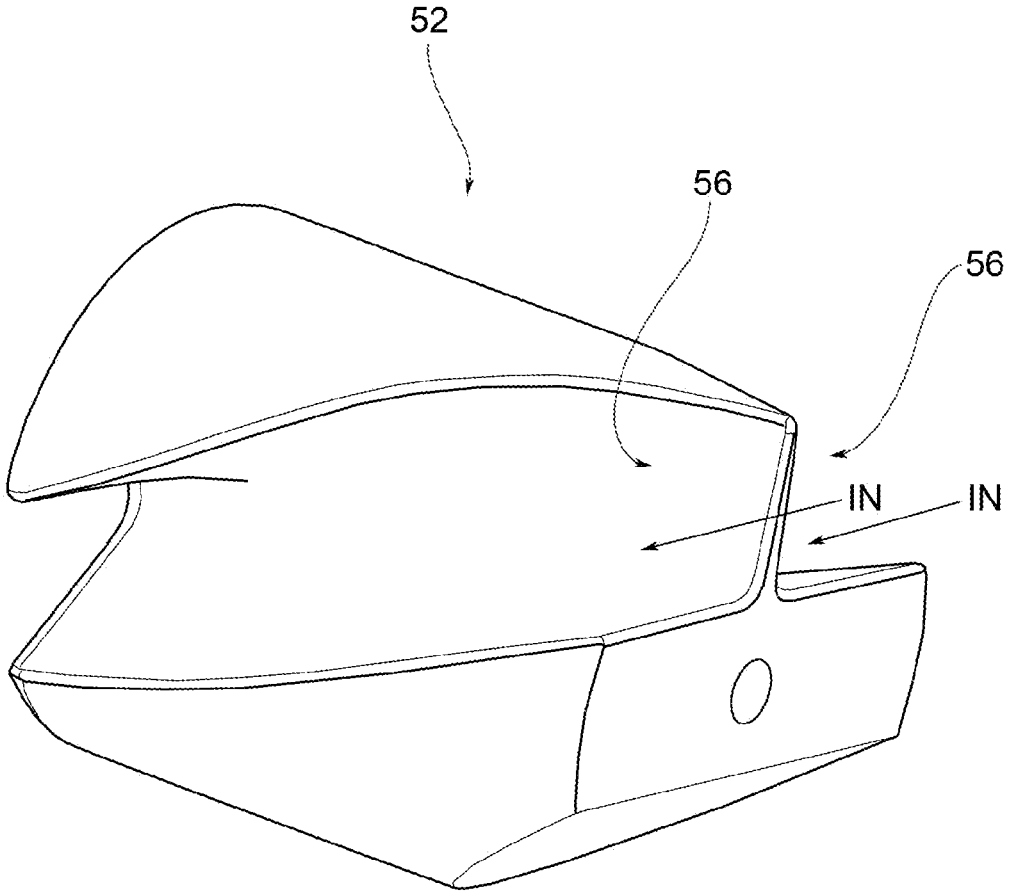
FIGS. 6-7 show perspective views, from the inlet side and from the outlet side, of an introducer nozzle according to a further possible embodiment of the present invention.
Figure 7:
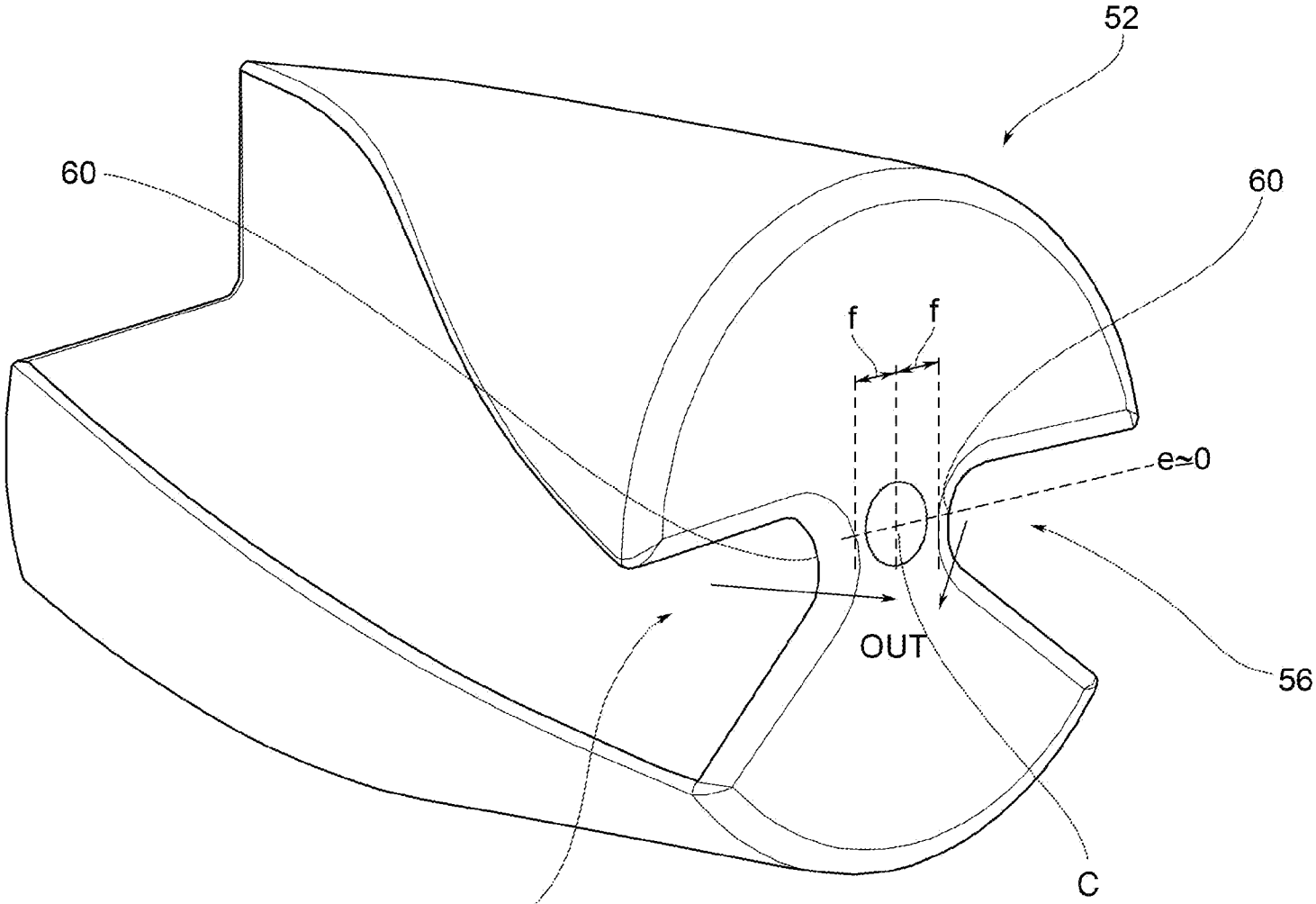
Figure 8:
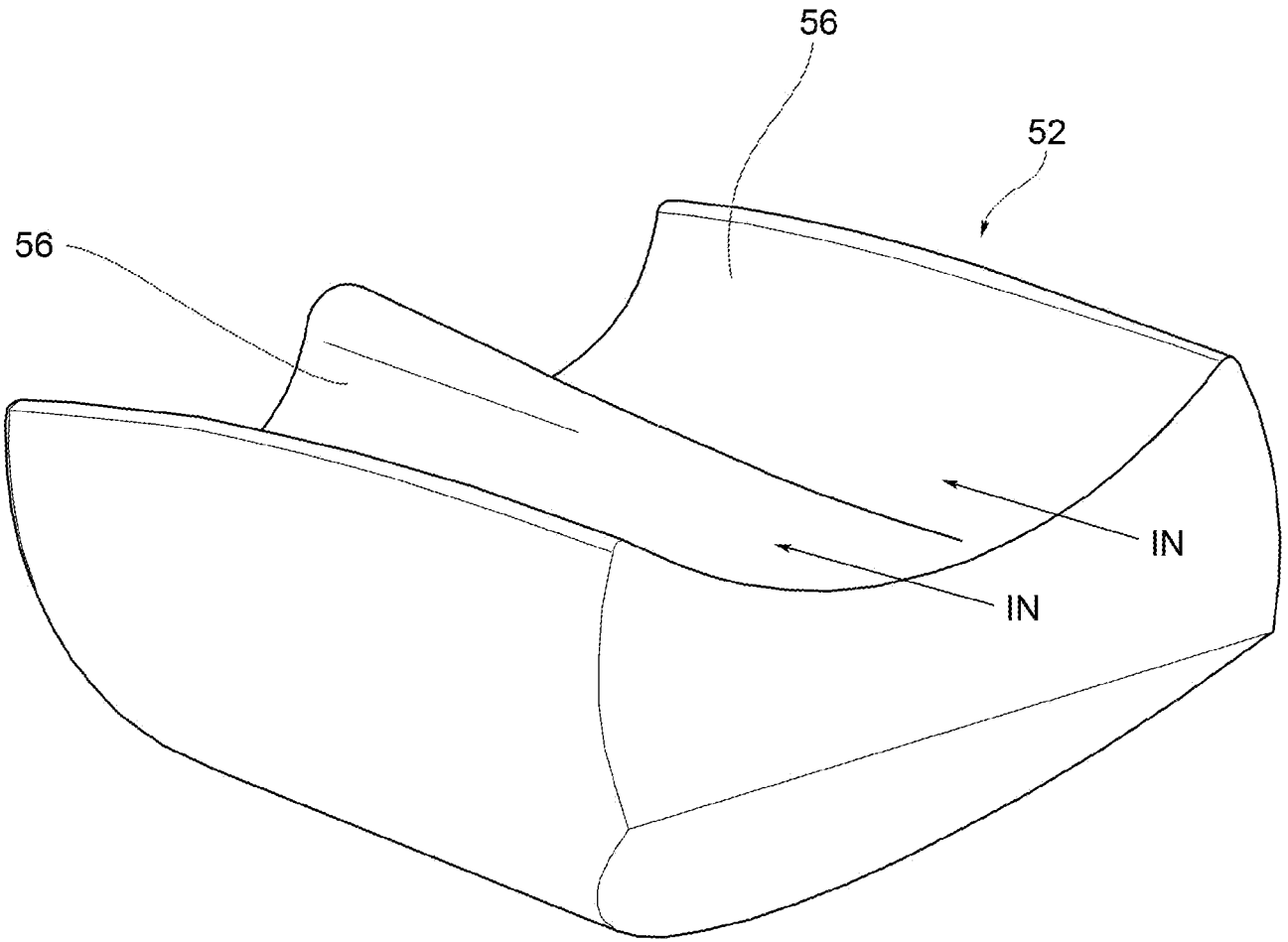
FIGS. 8-9 show perspective views, from the inlet side and from the outlet side, of an introducer nozzle according to a further possible embodiment of the present invention.
Figure 9:
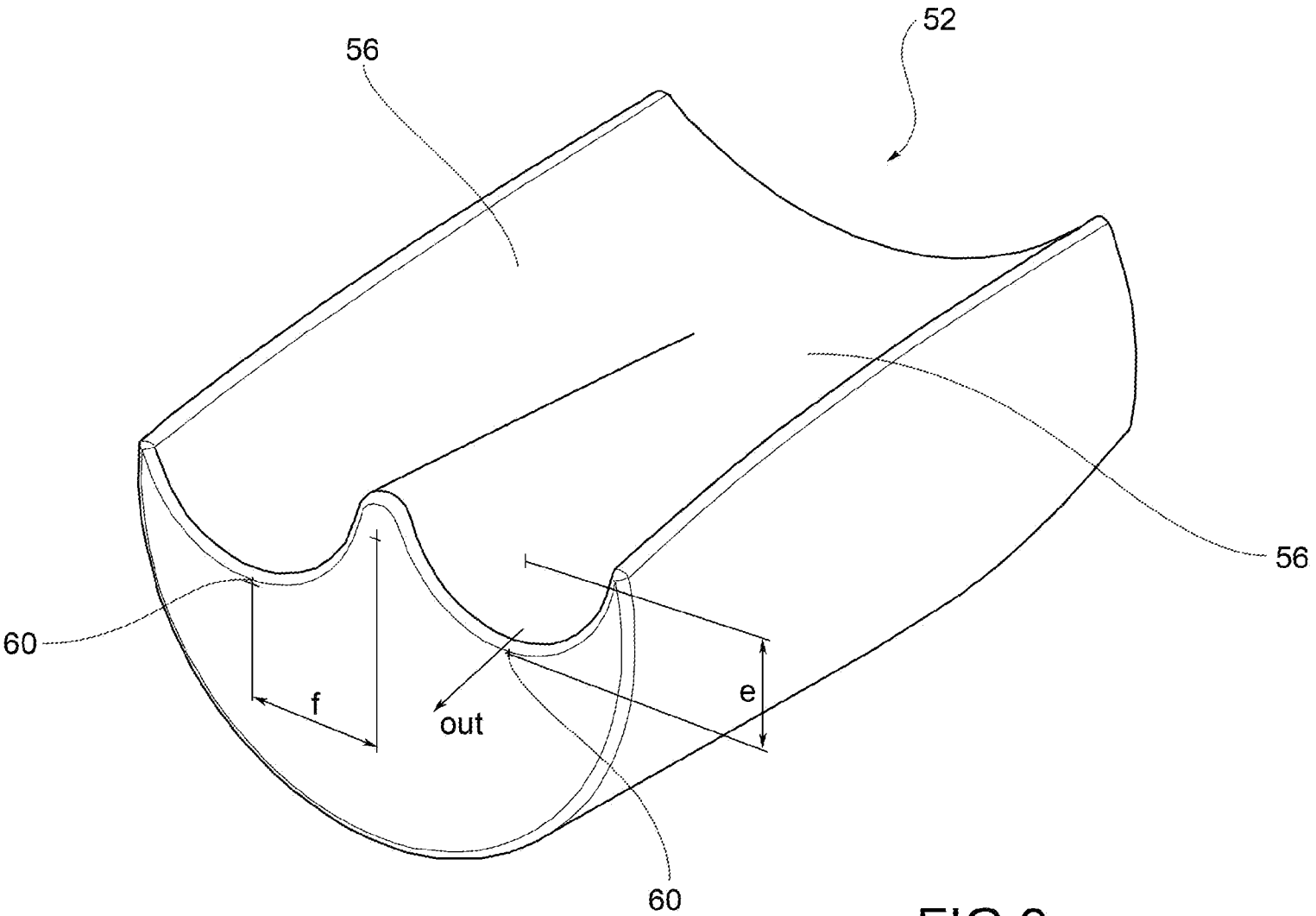

With reference to the aforesaid figures, reference numeral 4 indicates a drawing and spinning apparatus for air spinning machines with multiple feeds.

Said apparatus 4 comprises at least a first and a second introducer element 8, 12, independent of each other, so as to be able to feed simultaneously at least two webs N1, N2 of textile fibre. Said webs of textile fibres N1, N2 can be either equal to each other or different in quality, thread count, colour and/or material.

The apparatus 4 further comprises an air spinning device 16, fed with said webs of textile fibres N1, N2, suitable for producing yarn of certain features.

The apparatus 4 further comprises a drawing device 20, interposed between the introducer elements 8, 12 and the air spinning device 16, comprising a plurality of pairs of drawing cylinders 24.

According to one embodiment, said pairs of drawing cylinders 24 comprise at least one drive cylinder 28 per pair 24, said drawing cylinders being suitable for progressively drawing each web N1, N2 simultaneously intercepted thereby, in a known manner.

By drive cylinder 28 it is meant a cylinder operatively connected to drive means, typically electric motors; usually each drive cylinder 28 faces an idler cylinder 32 which presses on the webs N1, N2 with a suitable pressure and is set in motion by the drive cylinder 32 coupled thereto.

According to one embodiment, at least one drive cylinder 28 of a pair of said drawing cylinders 24 of the spinning apparatus 4 is mechanically split into a first drive cylinder which intercepts the first belt N1 and in a second drive cylinder which intercepts the second ribbon N2.

Said first and second drive cylinders are operatively connected to distinct drive means so as to be able to be operated at different speeds of rotation, to effect different degrees of drawing of the two webs N1, N2 intercepted by the first and second drive cylinders.

Preferably, the drawing device 4 comprises a plurality of pairs of drawing cylinders 24, in series with each other, suitable for progressively drawing each web N1, N2 simultaneously intercepted by them.

Preferably, the webs N1, N2 are fed according to a longitudinal feeding direction L, the introducer elements 8, 12 are placed side by side along a transverse direction Z, perpendicular to said longitudinal feeding direction L.

It should be noted that the longitudinal direction L is typically inclined with respect to a vertical direction Y, perpendicular to a horizontal direction X, parallel to a bearing plane of the spinning apparatus 4.

The first and second drive cylinders 36', 36" are aligned with each other parallel to said transverse direction Z and rotate around transversal axes of rotation, parallel to the transverse direction Z.

The number of pairs of drawing cylinders 24 can be varied according to the total drawing ratio to be obtained and is not binding for the purposes of the present invention.

The air spinning device 16 comprises a spinning chamber 40 comprises a plurality of jets of air 44, 48 oriented in a direction substantially tangential to the same webs N1, N2 in input to the spinning chamber 40 itself, so as to interweave said webs N1, N2 and obtain a single yarn F in output from the air spinning chamber 20.

Preferably, said air jets 44,48 are directed both in a tangential direction towards the centre C of the spinning chamber 40, so as to synergically trigger the torsion of the fibres of the webs N1, N2 according to a concordant direction. In other words, the two air jets 44, 48 are arranged and oriented so as to trigger both an hourly or anticlockwise twist on the fibres.

The drawing and spinning apparatus 4 further comprises an introducer nozzle 52 designed to receive the webs N1, N2 from the drawing device 20 in respective insertion channels and introduce the webs N1, N2 inside the spinning chamber 40 according to the longitudinal feeding direction L.

Advantageously, with respect to a cross-section plane perpendicular to said longitudinal feed direction L, groove bottoms 60 of each of said two insertion channels 56 of the webs N1, N2 into the spinning chamber 40 are aligned along a segment S which is offset by an eccentricity e with respect to a geometric centre C of the spinning chamber 40, through which a symmetry axis of the chamber itself 40 passes.

It should be noted that the groove bottoms 60 are to be considered at the outlet section of the webs N1, N2 from the introducer nozzle 52.

Said eccentricity e is less than 5% of a maximum diameter D of the spinning chamber 40.

Preferably, in absolute terms, said eccentricity e is less than 0.2 mm.

According to a preferred embodiment, said eccentricity e is equal to 0, so that the groove bottoms 60 of the insertion channels 56 of the webs N1, N2 into the spinning chamber 40 and the geometric centre C of the spinning chamber 40 are aligned with each other.

According to an embodiment, a radial distance f between the geometric centre C of the spinning chamber 40 and each groove bottom 60 is equal, so that said groove bottoms 60 are equidistant with respect to said geometric centre C.

Preferably, said radial distance f is less than 2% of the maximum diameter D of the spinning chamber 40.

Preferably, the radial distance f is such that each of said groove bottoms 60 is tangentially aligned with the corresponding air jet 44, 48.

According to a possible embodiment, the insertion channels 56 of the webs N1, N2 in the spinning chamber 40 are at least partially twisted with respect to an axis parallel to said longitudinal feeding direction L.

According to an embodiment, with respect to a cross-section plane perpendicular to the longitudinal feed direction L, the cross-section of the insertion channels 56, at the spinning chamber 40, has a triangular profile converging and rounded at said groove bottoms 60.

It is also possible to provide insertion channels 56 of the webs N1, N2 which are substantially straight and parallel to said longitudinal feed direction L.

Figure 10:
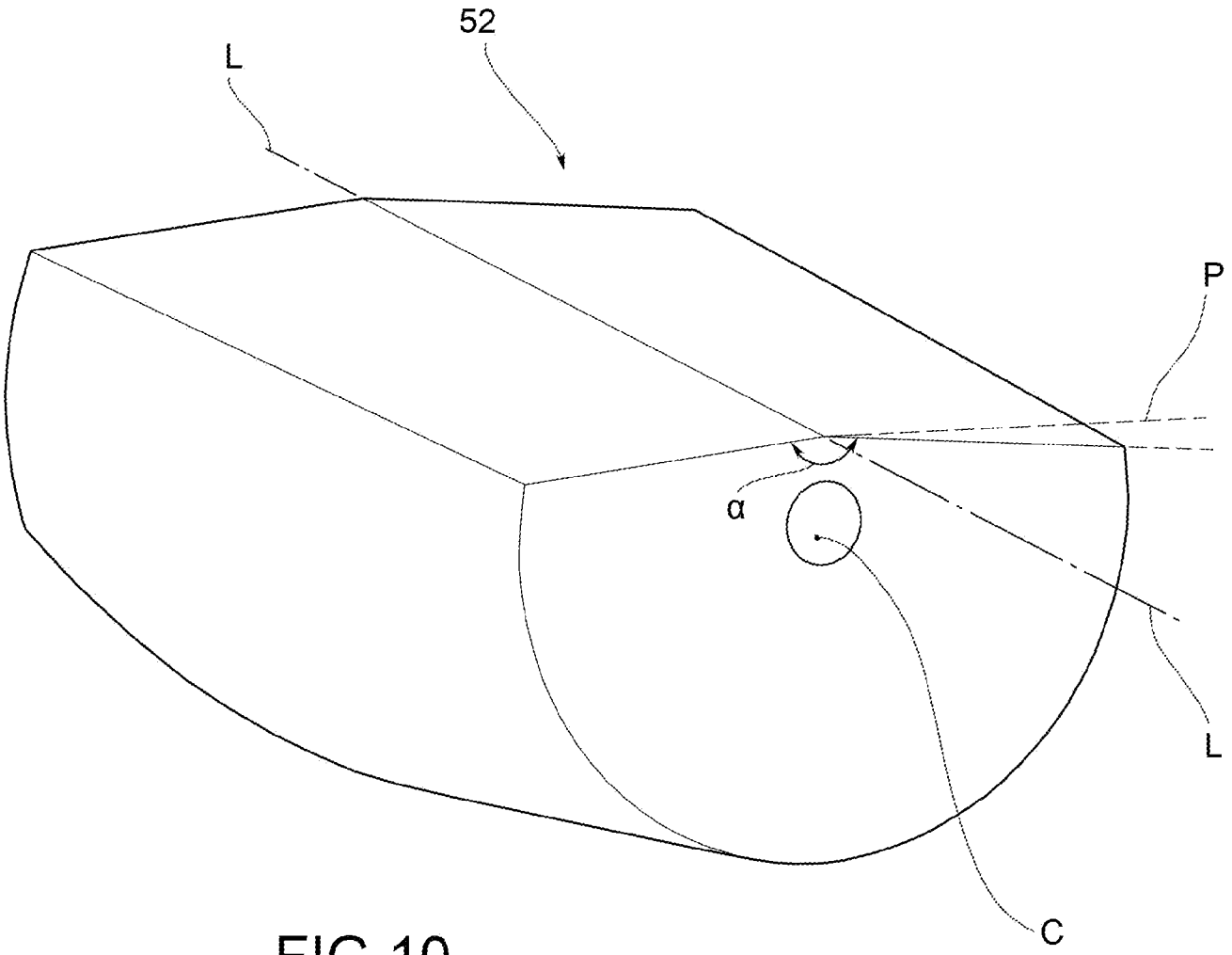
FIG. 10 shows a perspective view of an introducer nozzle according to a further possible embodiment of the present invention.
Figure 11:
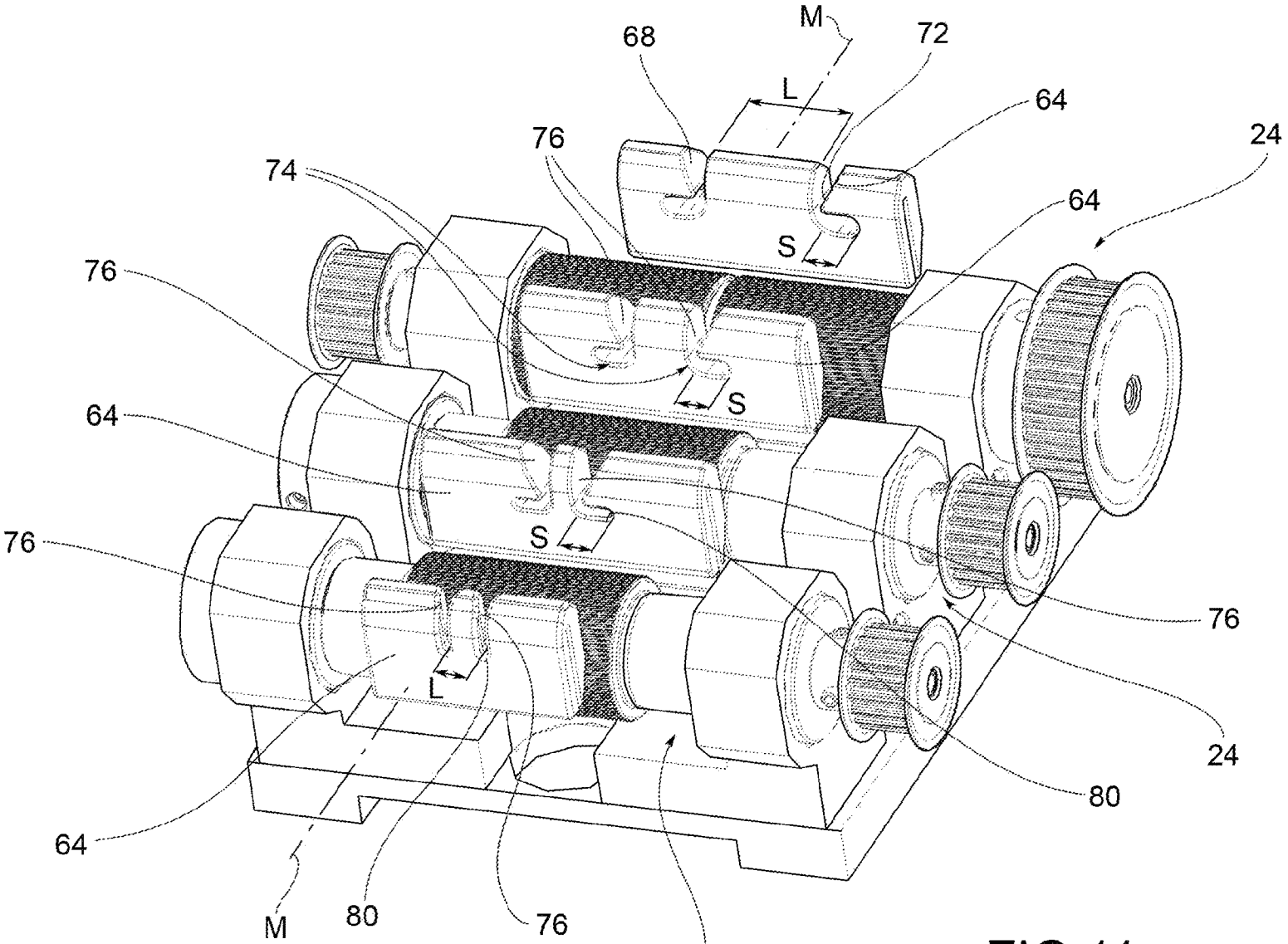
FIGS. 11-13 show perspective views of dual channel condensers according to possible embodiments of the present invention.
Figure 12A:
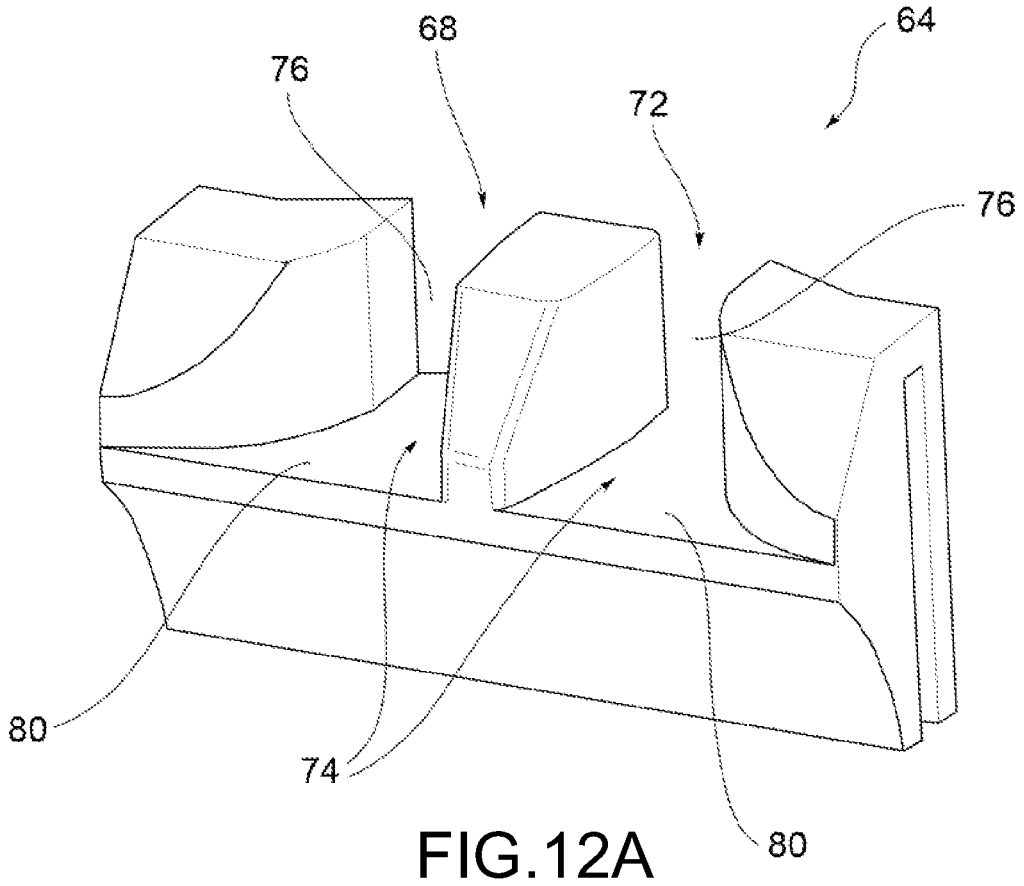
Figure 12B:
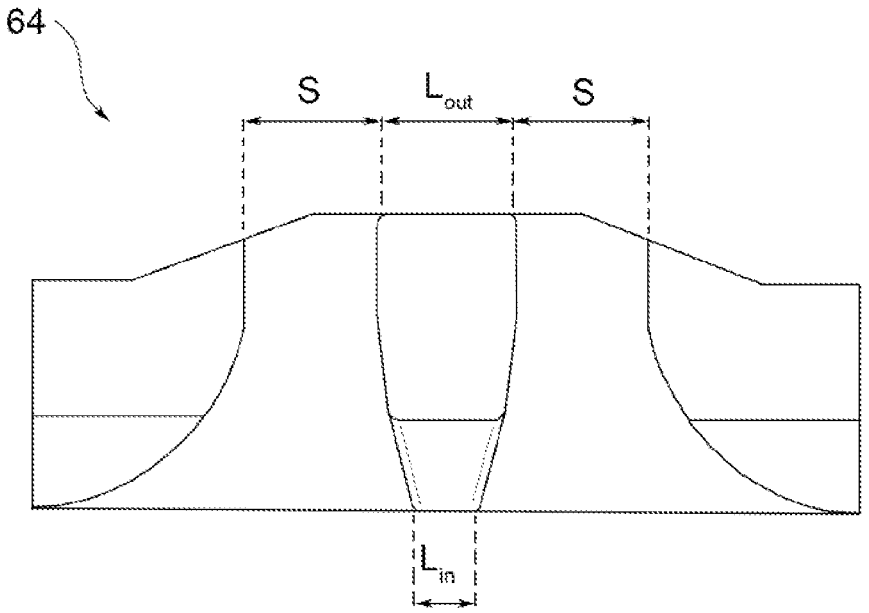
Figure 13:
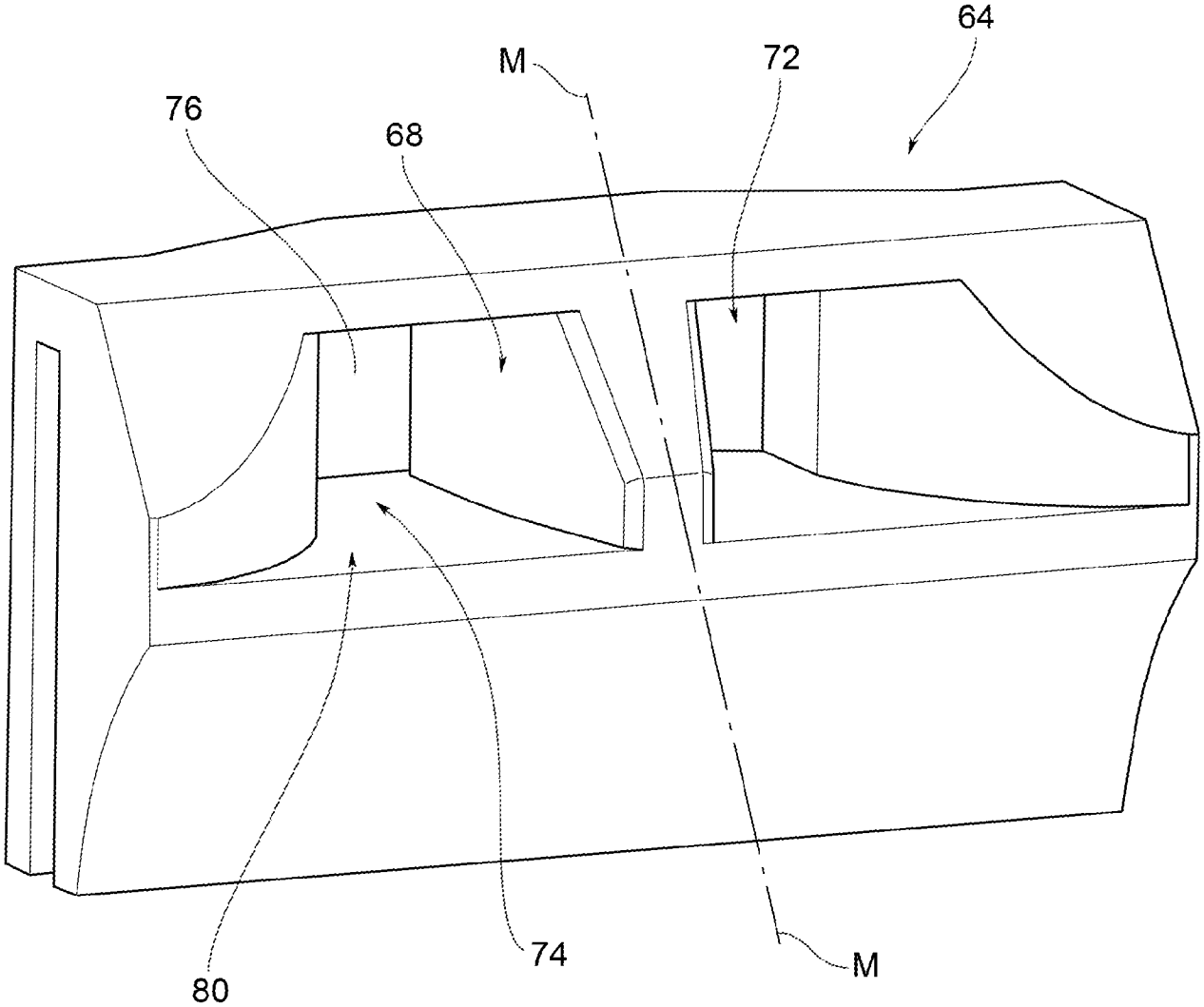

According to a further possible embodiment (FIG. 10), the introducer nozzle 52 comprises flat insertion channels 56 which are angled so that respective planes tangent to the channels identify an angle at the vertex $\alpha$ between 160° and 178°, preferably said angle at the vertex $\alpha$ is equal to 170°.

According to a possible embodiment, the drawing device comprises at least one dual channel condenser 64, comprising a pair of channels 68, 72, wherein each channel 68, 72 houses and guides one of said webs N1, N2 in the longitudinal feed direction L, limiting the excursion of the webs in the transverse direction Z-Z, perpendicular to said longitudinal feed direction L.

The dual channel condenser 64 is arranged in a centreline M-M between at least one pair of drawing cylinders 24, each acting on a respective web N1, N2.

Each channel 68, 72 is closed or self-threading, and comprises a seat 74 having a first input section 76, perpendicular to the longitudinal feed direction L to facilitate insertion of the web N1, N2, and a second retention section 80, directed in a transverse direction Z, perpendicular to the first input section 76, so as to limit the transverse distance of the web N1, N2 with respect to the centreline M-M of the condenser 64.

As seen, the drawing device 20 preferably comprises a plurality of pairs of drawing cylinders 24, arranged in series along the longitudinal feed direction L, each pair being provided with a dual channel condenser 64.

Preferably, in said series of condensers 64, the second retention portion 80 of each pair of successive cylinders 24 is lower than the corresponding second retention portion 80 of the preceding pair of cylinders, along said longitudinal feed direction. In this way, gradually, or progressively, the webs N1, N2 are approached towards the centreline M-M and therefore towards the centre of the subsequent spinning chamber 40.

It is possible to provide both embodiments in which said split condensers are open and therefore self-threading, and closed, non-self-threading condensers.

The operation and therefore the drawing method of an apparatus according to the present invention will now be described.

In particular, the apparatus introduces the two webs N1, N2 through the introducer elements 8,12 in the drawing devices.

Said at least two webs N1, N2 of textile fibres can be equal to each other or can be different from each other in quality, thread count, colour and/or material.

The webs N1, N2 are then drawn progressively by the pairs of drawing cylinders 24 until the desired drawing is obtained.

The drawn webs N1, N2 always separated from each other are fed into the spinning chamber 40 by the introducer nozzle 52. Inside the spinning chamber 40, the webs N1, N2 are subjected to the air jets 44, 48 which cause them to twist and mix, in a uniform, symmetrical and homogeneous manner.

It is important that the two webs N1, N2 are drawn separately up to insertion and output from the introducer nozzle 52, to then be joined exclusively inside the spinning chamber 40.

Preferably, the drawing and spinning method comprises the step of progressively approaching the webs N1, N2 during the subsequent drawing steps, by using condensers 64, without ever joining the webs N1, N2 before the respective entry into the spinning chamber 40.

It is possible to provide the step of modifying the degree of drawing of the two webs N1, N2, upon transit through said pairs of drawing rollers 24, so as to feed to the spinning chamber 40 webs N1, N2 different from each other and with a different degree of drawing.

As can be appreciated from the description, the present invention allows overcoming the drawbacks of the prior art.

In particular, the present invention allows eliminating the problem of bars in the case of obtaining mixed yarns by means of air spinning machines.

Said mixed yarns comprise both two webs of different colours, but also webs of the same colour, of the same material and of mixed material (for example cotton/polyester or viscose/polyester).

Moreover, the present invention allows the colorimetric yield of the final yarn to be controlled with extreme precision.

The principle underlying the present invention, which allows the aforementioned problems to be solved, is basically to make the action on the fibres as uniform as possible. This is achieved, as seen, in two ways.

The first way is to make the entry of the fibres symmetrical, that is as much as possible aligned with the centre of the spinning chamber. This causes the distance between the point of injection of the air in the chamber and the insertion point of the fibres to be the same for both fibre flows of the respective webs.

In this way, despite the fact that the speed of the air leaving the injection points decreases rapidly as the fluid is expanding rapidly, the two fibre flows are subjected to very similar aerodynamic actions.

The second method consists in changing the distance between the main air flow and the fibre area.

In particular, by bringing the inlets of the fibres in the chamber as close as possible to the centre, the influence of the air flows and the relative non-uniformity due to any differences in these flows is limited.

In general, the feed channels are separated up to the entry into the spinning chamber, where the webs are coupled; furthermore, said webs, coming out of the feeding channels, come out as close as possible to the centre of the spinning chamber so as to guarantee a symmetrical and homogeneous mixing. Thanks to this symmetry and homogeneity, it is possible to exactly replicate and control the mixing of the fibres inside the spinning chamber, both in order to avoid barring, and in order to dose the colours exactly and at will to obtain the desired final effect of coloration.

Therefore, on the one hand the webs are prepared with extreme precision but distanced and separated before the entry into the spinning chamber, and on the other hand they twist and mix in the position closest to the centre, inside the spinning chamber.

The dual channel, self-threading condensers allow further improvement of the web preparation and threading operation before entering the spinning chamber.

Preferably, as seen, a condenser is positioned between each pair of drawing rollers, with the width of separation of the webs gradually decreasing from the entry into the drawing group to the exit from the drawing group and entry into the spinning chamber.

In this way, the approach of the webs, which remain strictly separated in the drawing group, takes place gradually, up to the entrance into the spinning chamber.

In order to satisfy contingent and specific needs, a man skilled in the art will be able to make numerous modifications and variations to the air-jet spinning methods and devices for mixed yarns described above, all of which fall within the scope of the invention as defined by the following claims.

The invention claimed is:

1. A drawing and spinning apparatus of mixed yarns for air spinning machines with multiple feeds, comprising:

at least a first and a second introducer element, independent of each other, so as to be able to feed simultaneously at least two separate webs of textile fibre;

an air spinning device suitable to spin said webs of textile fibre;

an air spinning device chamber for interweaving said webs of textile fibres, wherein the air spinning device chamber comprises an introducer nozzle adjacent therewith, the introducer nozzle being structured to receive the webs from a drawing device, wherein the introducer nozzle is placed between the drawing device and the air spinning device, wherein the introducer nozzle comprises two insertion channels structured to introduce the webs inside the spinning chamber in a longitudinal feed direction, wherein the introducer nozzle is further structured to maintain separation of the webs until the webs are introduced inside the spinning chamber;

wherein said spinning chamber comprises a plurality of jets of air oriented in a direction substantially tangential to the webs in input to the spinning chamber, so as to interweave said webs and obtain a single yarn in output from the spinning chamber; and wherein, with respect to a cross-section plane perpendicular to said longitudinal feed direction, groove bottoms of each of said two insertion channels are offset by an eccentricity with respect to a geometric centre of the spinning chamber, through which a symmetry axis of the spinning chamber passes, said eccentricity being less than 5% of a maximum diameter of the spinning chamber.

2. The drawing and spinning apparatus of mixed yarns for air spinning machines with multiple feeds according to claim 1, wherein said eccentricity is less than 0.2 mm.

3. The drawing and spinning apparatus of mixed yarns for air spinning machines with multiple feeds according to claim 1, wherein said eccentricity is equal to 0, so that the groove bottoms of the insertion channels and the geometric centre of the spinning chamber are aligned with each other.

4. The drawing and spinning apparatus of mixed yarns for air spinning machines with multiple feeds according to claim 1, wherein a radial distance between the geometric centre of the spinning chamber and each groove bottom is equal, so that said groove bottoms are equidistant with respect to said geometric centre.

5. The drawing and spinning apparatus of mixed yarns for air spinning machines with multiple feeds according to claim 4, wherein said radial distance is less than 2% of the maximum diameter of the spinning chamber.

6. The drawing and spinning apparatus of mixed yarns for air spinning machines with multiple feeds according to claim 4, wherein said radial distance is such that each of said groove bottoms is tangentially aligned with a corresponding air jet of the plurality of jets of air.

7. The drawing and spinning apparatus of mixed yarns for air spinning machines with multiple feeds according to claim 1, wherein the insertion channels are at least partially twisted with respect to an axis parallel to said longitudinal feed direction.

8. The drawing and spinning apparatus of mixed yarns for air spinning machines with multiple feeds according to claim 1, wherein with respect to a cross-section plane perpendicular to the longitudinal feed direction, the cross-section of the insertion channels, at the spinning chamber, has a triangular profile converging and rounded at said groove bottoms.

9. The drawing and spinning apparatus of mixed yarns for air spinning machines with multiple feeds according to claim 1, wherein the insertion channels are substantially parallel to said longitudinal feed direction.

10. The drawing and spinning apparatus of mixed yarns for air spinning machines with multiple feeds according to claim 1, wherein the insertion channels of the introducer nozzle are flat and define respective planes tangent to the insertion channels, wherein the respective planes form an angle at a vertex $\alpha$ between 160° and 178°.

11. The drawing and spinning apparatus of mixed yarns for air spinning machines with multiple feeds according to claim 1, wherein said plurality of jets of air are directed in a tangential direction towards the centre of the spinning chamber, so as to synergically trigger the twisting of the fibres of the webs.

12. The drawing and spinning apparatus of mixed yarns for air spinning machines with multiple feeds according to claim 1, wherein the drawing device comprises a plurality of pairs of drawing cylinders, in series with each other, suitable to perform a progressive drawing of each web simultaneously intercepted thereby.

13. The drawing and spinning apparatus of mixed yarns for air spinning machines with multiple feeds according to claim 12, wherein the plurality of pairs of drawing cylinders comprise a drive cylinder and an idler cylinder per pair.

14. The drawing and spinning apparatus of mixed yarns for air spinning machines with multiple feeds according to claim 1, wherein the drawing device comprises at least one dual channel condenser, comprising a pair of channels, each channel housing and guiding one of said webs in the longitudinal feed direction, limiting an excursion of the webs in a transverse direction, perpendicular to said longitudinal feed direction.

15. The drawing and spinning apparatus of mixed yarns for air spinning machines with multiple feeds according to claim 14, wherein the dual channel condenser is placed on a centreline between at least one pair of drawing cylinders, each acting on a respective web.

16. The drawing and spinning apparatus of mixed yarns for air spinning machines with multiple feeds according to claim 14, wherein each channel of the condenser is self-threading, and comprises a seat having a first input section, perpendicular to the longitudinal feed direction to facilitate insertion of the web, and a second retention section, directed in the transverse direction, perpendicular to the first input section, so as to limit the transverse distance of the web with respect to a centreline of the dual channel condenser.

17. The drawing and spinning apparatus of mixed yarns for air spinning machines with multiple feeds according to claim 14, wherein the drawing device comprises a plurality of pairs of drawing cylinders, arranged in series along the longitudinal feed direction, each pair of drawing cylinders being provided with a dual channel condenser, wherein a second retention section of each pair of drawing cylinders is lower than a corresponding second retention section of a previous pair of drawing cylinders along said longitudinal feed direction.

18. A drawing and spinning method of mixed yarns for air spinning machines with multiple feeds comprising the steps of:

providing the drawing and spinning apparatus according to claim 1;

preparing at least two webs of textile fibres, to be fed by at least the first introducer element and the second introducer element, upstream of the air spinning device;

drawing said webs, separated from each other, with pairs of drawing cylinders suitable for performing a progressive drawing of each web simultaneously intercepted thereby; and feeding said webs drawn and separate from each other into the spinning chamber of the spinning device, by means of said introducer nozzle to obtain a desired yarn.

19. The drawing and spinning method of mixed yarns for air spinning machines with multiple feeds according to claim 18, wherein said at least two webs of textile fibres are of the same quality, color, or material.

20. The drawing and spinning method of mixed yarns for air spinning machines with multiple feeds according to claim 18, wherein said at least two webs of textile fibres are different from each other in terms of quality, colour, or material.

21. The drawing and spinning method of mixed yarns for air spinning machines with multiple feeds according to claim 18, comprising the step of:

drawing the two webs separately up to insertion and output from the introducer nozzle, joining said webs exclusively inside the spinning chamber.

22. The drawing and spinning method of mixed yarns for air spinning machines with multiple feeds according to claim 18, comprising the step of progressively juxtaposing the webs during the subsequent drawing steps, by using condensers, without ever joining the webs before the respective entrance into the spinning chamber.

23. The drawing and spinning method of mixed yarns for air spinning machines with multiple feeds according to claim 18, comprising the step of:

modifying a degree of drawing of the two webs, upon transit through pairs of drawing rollers, so as to feed to the spinning chamber webs different from each other and with a different degree of drawing.

* * * * *